US006127077A

United States Patent [19]

Pai et al.

[11] Patent Number: 6,127,077

[45] Date of Patent: Oct. 3, 2000

[54] PHOTORECEPTORS WITH DELAYED DISCHARGE

[75] Inventors: Damodar M. Pai, Fairport; Chu-Heng Liu, Penfield; John F. Yanus, Webster; Timothy J. Fuller, Pittsford; Markus R. Silvestri, Fairport, all of N.Y.

[73] Assignee: Xerox Corporation, Stamford, Conn.

[21] Appl. No.: 09/152,972

[22] Filed: Sep. 14, 1998

[51] Int. Cl.[7] ..... G03G 5/047

[52] U.S. Cl. ..... 430/58.7; 430/59.6; 430/58.05

[58] Field of Search ..... 430/58.05, 58.75, 430/58.8, 58.7, 59.6

[56] References Cited

U.S. PATENT DOCUMENTS

| | | | |
|---|---|---|---|
| 4,727,009 | 2/1988 | Takai | 430/58 |
| 4,784,928 | 11/1988 | Kan et al. | 430/58 |
| 4,806,443 | 2/1989 | Yanus et al. | 430/56 |
| 4,806,444 | 2/1989 | Yanus et al. | 430/56 |
| 4,847,175 | 7/1989 | Pavlisko et al. | 430/58.05 |
| 4,889,784 | 12/1989 | Champ et al. | 430/58 |
| 5,028,502 | 7/1991 | Yuh et al. | 430/31 |
| 5,436,706 | 7/1995 | Landa et al. | 355/256 |
| 5,468,583 | 11/1995 | Gruenbaum et al. | 430/58 |
| 5,596,396 | 1/1997 | Landa et al. | 399/237 |
| 5,677,094 | 10/1997 | Umeda et al. | 430/58.05 |
| 5,830,614 | 11/1998 | Pai et al. | 430/96 |
| 5,834,146 | 11/1998 | Hoshizaki et al. | 430/58.75 |

FOREIGN PATENT DOCUMENTS

| | | | |
|---|---|---|---|
| 5-119485 | 5/1993 | Japan | 430/58.05 |

OTHER PUBLICATIONS

Diamond, Arthur S. Handbook of Imaging Materials. New York: Marcel–Dekker, Inc. pp. 427–434, 1991.

*Primary Examiner*—Christopher D. Rodee
*Attorney, Agent, or Firm*—Zosan S. Soong

[57] ABSTRACT

A photoreceptor having a substrate, including: (a) a charge generating layer; (b) a first charge transport layer having a first charge carrier mobility value; and (c) a second charge transport layer having a second charge carrier mobility value, wherein the first charge transport layer is closer to the charge generating layer than the second charge transport layer and the second charge transport layer is contiguous to the first charge transport layer, wherein the second charge carrier mobility value is higher than the first charge carrier mobility value.

7 Claims, 2 Drawing Sheets

PHOTORECEPTORS WITH DELAYED DISCHARGE

CROSS REFERENCE TO RELATED APPLICATIONS

Attention is hereby directed to concurrently filed U.S. application Ser. No. 09/153,214 now U.S. Pat. No. 6,068,960 having the inventors Damodar M. Pai et al. and titled "METHODS TO PREPARE PHOTORECEPTORS WITH DELAYED DISCHARGE."

FIELD OF THE INVENTION

This invention relates to photoreceptors and their fabrication. These photoreceptors are useful in an electrostatographic printing machine, especially a printing machine that employs a contact electrostatic printing process.

BACKGROUND OF THE INVENTION

Various methods of developing a latent image have been described in the art of electrophotographic printing and copying systems. Of particular interest with respect to the present invention is the concept of splitting a thin layer of liquid developing material into image and background portions such as the processes disclosed in U.S. Pat. No. 5,826,147 and U.S. Pat. No. 5,937,243, the disclosures of which are totally incorporated herein by reference. In this process, a thin and substantially uniform layer of high concentration liquid developing material is laid onto a latent image bearing surface. A second latent image is created in the toner layer in response to the original latent image. With the latent image bearing toner layer being brought into contact with a separator member, wherein development of the latent image occurs upon separation of the first and second surfaces, as a function of the electric force strength generated by the latent image. In this process, toner particle migration or electrophoresis is replaced by direct surface-to-surface transfer of a toner layer induced by image-wise forces. For the present description, the concept of latent image development via direct surface-to-surface transfer of a toner layer via image-wise forces will be identified generally as Contact Electrostatic Printing (CEP).

One of the embodiments of the CEP process calls for the deposition of a uniform layer of charged marking particles (also referred herein as an ink cake film) on a photoreceptor that has been image-wise exposed. There is a general concern about the uniformity of the ink cake film due to the existence of the latent image. To overcome this non-uniformity problem, there is generally required the application of a very high voltage on the ink cake film donor roll. The voltage on the donor roll, however, is limited by air breakdown in the nip exit due to Paschen breakdown which will damage or destroy the latent image. It would be desirable to have a photoreceptor that has been exposed to light not undergo substantial discharge until after the ink cake film has been applied in order to achieve both ink cake uniformity and latent image fidelity. The present inventors have discovered new photoreceptors and new methods for their preparation wherein the photoreceptor that has been exposed to light does not undergo substantial discharge until after the ink cake film has been applied. The delayed discharge is to be distinguished from the traditional supply limited discharge and the S shaped discharge (also called induction period discharge).

In the traditional discharge depicted in FIG. 1, the supply of carriers from the generator layer into the transport layer controls the shape of the discharge. The supply efficiency (charges injected into the transport layer per photon absorbed in the generator layer) is a product of the photogeneration efficiency and the injection (from the generator layer into the transport layer) efficiency. The amount of charge neutralized on the surface as measured by the voltage across the photoconducting layers is equal to the charges supplied from the generator layer into the transport layer. The photodischarge curve is linear with a negative slope from the maximum (dark or zero exposure) to the minimum voltage. In such supply limited discharge, the ideal discharge is a linear discharge down to zero or residual voltage with the slope being a measure of the photosensitivity. However, since the photogeneration rate and injection rate in practical materials is electric field dependent and decreasing with field, the discharge slope decreases and the discharge curve at low voltages increasingly departs from the linear discharge.

The S shaped discharge (depicted in FIG. 2) employed in the digital systems is generated by fabricating a particle contact layer in one embodiment of which photocoductor particles are dispersed in insulating binders. The concentration of the charge generating and transporting pigment particles is high enough to maintain particle contact and thus a conducting path through the layer. The key to this S shaped photodischarge is a heterogeneous structure which provides a connected but convoluted path for charge transport or conduction. At high electric fields, after the sample is charged, any charge photogenerated at the surface is directed in a straight line through the layer, encounters a barrier in the insulating region and causes negligible voltage discharge. After nearly all the surface charge is injected, the local electric field normal to the surface is negligible and the remaining charge is able to move in other directions and follow the connected path to a depth below where the initial charge was stopped. At this deeper level the charge again sees the full electric field and encounters the insulating barrier. But because the motion of the previous charge reduced the electric field in the first level, more charge follows the convoluted path down to the next level. Thus by such a cascade, total discharge occurs after a light exposure corresponding to the generation of enough charge required for total discharge, resulting in a step like or S shaped discharge curve. In this S shaped discharge, the induction period is not a time effect but a photon flux effect (as a function of the number of photons in the flash) whereas the delayed discharge (depicted in FIG. 3) discussed in this invention is delayed in time after exposure.

Conventional photoreceptors are disclosed in Takai, U.S. Pat. No. 4,727,009; Kan et al., U.S. Pat. No. 4,784,928; Champ et al., U.S. Pat. No. 4,889,784; Gruenbaum et al., U.S. Pat. No. 5,468,583; Yuh et al., U.S. Pat. No. 5,028,502; Yanus et al., U.S. Pat. No. 4,806,443; and Yanus et al., U.S. Pat. No. 4,806,444.

SUMMARY OF THE INVENTION

The present invention is accomplished in embodiments by providing a photoreceptor having a substrate, comprising:

(a) a charge generating layer;

(b) a first charge transport layer having a first charge carrier mobility value; and (c) a second charge transport layer having a second charge carrier mobility value, wherein the first charge transport layer is closer to the charge generating layer than the second charge transport layer and the second charge transport layer is contiguous to the first charge transport layer, wherein the second charge carrier mobility value is higher than the first charge carrier mobility value.

DETAILED DESCRIPTION

Figure 1:
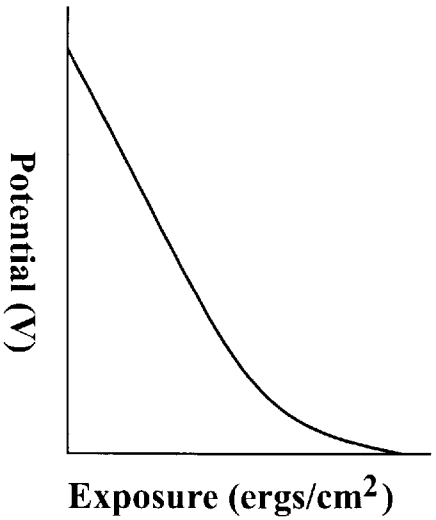
FIG. 1 PRIOR ART
FIG. 1 is a graph illustrating the traditional supply limited discharge curve of one type of conventional photoreceptors.
Figure 2:
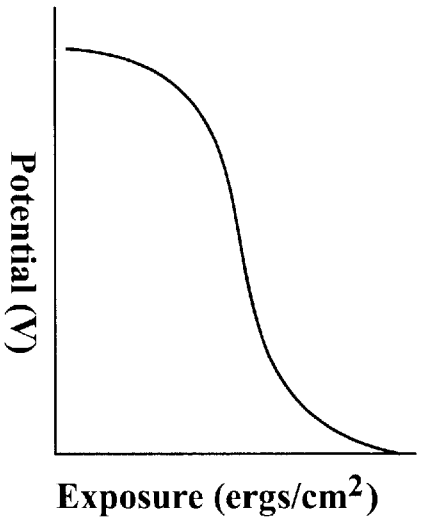
FIG. 2 PRIOR ART
FIG. 2 is a graph illustrating the S shaped discharge curve of another type of conventional photoreceptors.
Figure 3:
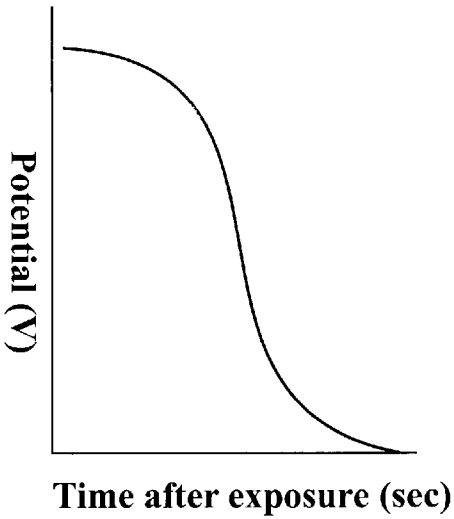
FIG. 3 is a graph illustrating the delayed discharge of the present inventive photoreceptors.

Several photoreceptor configurations are encompassed by the present invention. A preferred configuration is in the recited order: a substrate; a generating layer; a first charge transport layer; and a second charge transport layer. Another possible configuration of the present photoreceptor is in the recited order: a substrate; a second charge transport layer; a first charge transport layer; and a charge generating layer. Unless otherwise indicated, the phrase recited order includes intervening layer(s) or step(s).

Electrostatographic imaging members may be prepared by various suitable techniques. Typically, a flexible or rigid substrate is provided having an electrically conductive surface. A charge generating layer is then usually applied to the electrically conductive surface. An optional charge blocking layer may be applied to the electrically conductive surface prior to the application of the charge generating layer. If desired, an adhesive layer may be utilized between the charge blocking layer and the charge generating layer. Usually the charge generating layer is applied onto the blocking layer and a charge transport layer is formed on the charge generating layer. However, in some embodiments, the charge transport layer is applied prior to the charge generating layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like. The electrically insulating or conductive substrate may be in the form of a rigid cylinder or a flexible belt.

The thickness of the substrate layer depends on numerous factors, including strength and rigidity desired and economical considerations. Thus, this layer may be of substantial thickness, for example, about 5000 micrometers, or of minimum thickness of less than about 150 micrometers, provided there are no adverse effects on the final electrostatographic device. The surface of the substrate layer is preferably cleaned prior to coating to promote greater adhesion of the deposited coating. Cleaning may be effected, for example, by exposing the surface of the substrate layer to plasma discharge, ion bombardment and the like.

The conductive layer of the substrate may vary in thickness over substantially wide ranges depending on the optical transparency and degree of flexibility desired for the electrostatographic member. Accordingly, for a photoresponsive imaging device having an electrically insulating, transparent cylinder, the thickness of the conductive layer may be between about 10 angstrom units to about 500 angstrom units, and more preferably from about 100 Angstrom units to about 200 angstrom units for an optimum combination of electrical conductivity and light transmission. The conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g., a polyester web substrate such as MYLAR™ available from E. I. du Pont de Nemours & Co. with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide forms on the outer surface of most metals upon exposure to air. Thus, when another layer overlying the metal layer is characterized as a "contiguous" layer, it is intended that this overlying contiguous layer may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^3$ ohms/square.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. For negatively charged photoreceptors the blocking layer allows electrons to migrate toward the conducting layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino) titanate, titanium-4-amino benzene sulfonate oxyacetate, titanium 4-aminobenzoate isostearate oxyacetate, $(H_2N(CH_2)_4)CH_3Si(OCH_3)_2$, (gamma-aminobutyl)methyl diethoxysilane, and $(H_2N(CH_2)_3)CH_3Si(OCH_3)_2$ (gamma-aminopropyl)methyl diethoxysilane, as disclosed in U.S. Pat. No. 4,291,110, 4,338,387, 4,286,033 and 4,291,110. A preferred blocking layer comprises a reaction product between a hydrolyzed silane and the oxidized surface of a metal ground plane layer. The oxidized surface inherently forms on the outer surface of most metal ground plane layers when exposed to air after deposition. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layers should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, duPont 49,000 (available from E. I. duPont de Nemours and Company), VITEL PE100™ (available from Goodyear Tire & Rubber), polyurethanes, and the like. Satisfactory results may be achieved with adhesive layer thickness between about 0.05 micrometer (500 angstrom) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra-red radiation drying, air drying and the like.

Any suitable charge generating layer (also referred herein as a photogenerating layer) may be applied to the blocking layer or adhesive layer, if one is employed, which can thereafter be overcoated with a contiguous hole transport layer. Examples of charge generating layer materials include, for example, inorganic photoconductive materials such as amorphous selenium, trigonal selenium, and selenium alloys selected from the group consisting of selenium—tellurium, selenium—tellurium—arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, quinacridones, dibromoanthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer.

Any suitable polymeric film forming binder material may be employed as the matrix in the charge generating layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The charge generating material is present in the resinous binder composition in various amounts. Generally, from about 5 percent by volume to about 90 percent by volume of the charge generating material is dispersed in about 10 percent by volume to about 95 percent by volume of the resinous binder, and preferably from about 20 percent by volume to about 50 percent by volume of the charge generating material is dispersed in about 50 percent by volume to about 80 percent by volume of the resinous binder composition. In one embodiment about 8 percent by volume of the charge generating material is dispersed in about 92 percent by volume of the resinous binder composition.

The charge generating layer generally ranges in thickness of from about 0.1 micrometer to about 5.0 micrometers, and preferably has a thickness of from about 0.3 micrometer to about 3 micrometers. A thickness outside these ranges can be selected providing the objectives of the present invention are achieved.

Any suitable and conventional technique may be utilized to mix and thereafter apply the charge generating layer coating mixture. Typical application techniques include spraying, dip coating, roll coating, wire wound rod coating, and the like. Drying of the deposited coating may be effected by any suitable conventional technique such as oven drying, infra-red radiation drying, air drying and the like.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone.

Preferred charge transport materials are aromatic diamine compounds which are represented by the general formula:

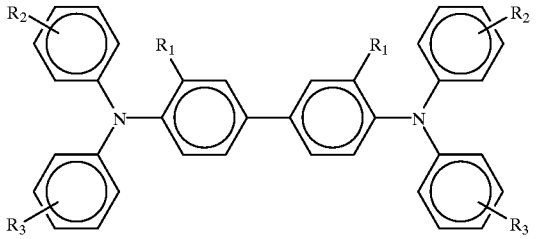

wherein $R_1$, $R_2$ and $R_3$ are independently selected from the group consisting of hydrogen, $CH_3$, $C_2H_5$, $OCH_3$, Cl and alkoxycarbonyl. Typical charge transporting aromatic amines represented by the structural formula above capable of supporting the injection of photogenerated holes and transporting the holes through the overcoating layer include N,N'-diphenyl-N,N'-bis(alkylphenyl)-(1,1'-biphenyl)-4,4'-diamine wherein the alkyl is, for example, methyl, ethyl, propyl, n-butyl and the like, N,N'-diphenyl-N,N'-bis(chlorophenyl)-(1,1'-biphenyl-)-4,4'-diamine, N,N'-diphenyl-N,N'-bis(3-methylphenyl)-(1,1'-biphenyl)-4,4'-diamine, N,N,N',N'-tetraphenyl-(3,3'-dimethyl-1,1'-biphenyl)-4,4'-diamine; N,N'-diphenyl-N,N'-bis(2-methylphenyl)-(3,3'-dimethyl-1,1'-biphenyl)-4,4'-diamine; N,N'-diphenyl-N,N'-bis(3-methylphenyl)-(3,3'-dimethyl-1,1'-biphenyl)-4,4'-diamine; N,N'-diphenyl-N,N'-bis(4-methylphenyl)-(3,3'-dimethyl-1,1'-biphenyl)-4,4'-diamine; N,N,N',N'-tetra(2-methylphenyl)-(3,3'-dimethyl-1,1'-biphenyl)- 4,4'-diamine; N,N'-bis(2-methylphenyl)-N,N'-bis(4-methylphenyl)-(3,3'-dimethyl-1,1'-biphenyl)-4,4'-diamine; N,N'-bis(3-methylphenyl)-N,N'-bis(2-methylphenyl)-(3,3'-dimethyl-1,1'-biphenyl)-4,4'-diamine; N,N,N',N'-tetra(3-methylphenyl)-(3,3'-dimethyl-1,1'-biphenyl)-4,4'-diamine; N,N'-bis(3-methylphenyl)-N,N'-bis(4-methylphenyl)-(3,3'-dimethyl-1,1'-biphenyl)-4,4'-diamine; and N,N,N',N'-tetra(4-methylphenyl)-(3,3'-dimethyl-1,1'-biphenyl)-4,4'-diamine.

Typical charge transporting hydrazones capable of supporting the injection of photogenerated holes and transporting the holes through the overcoating layer include: p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), ip-diethylaminobenzaldehyde-(benzylphenylhydrazone), p-dibutylaminobenzaldehyde-(diphenylhydrazone), p-dimethylaminobenzaldehyde-(diphenylhydrazone), 4-dimethylaminobenzaldehyde-1,2(diphenylhydrazone), and the like.

Any suitable inactive resin binder may be employed in each charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000. The transport material can be present in an amount ranging from about 5 to about 80 weight percent, the balance in each charge transport layer being the binder.

Preferred polymeric compounds for the charge transport layer(s) are disclosed in Yanus et al., U.S. Pat. No. 4,806,443, the disclosure of which is totally incorporated herein by reference. In this patent, there are described polymeric compounds having the general structure shown below where the charge transport moiety is covalently bonded to the binder moiety (polyethercarbonate):

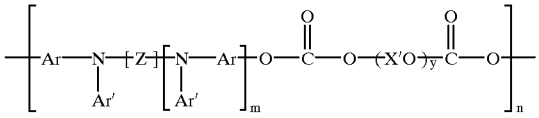

wherein n is between about 5 and about 5,000,
m is 0 or 1, y is 1, 2 or 3

Z is selected from the group consisting of:

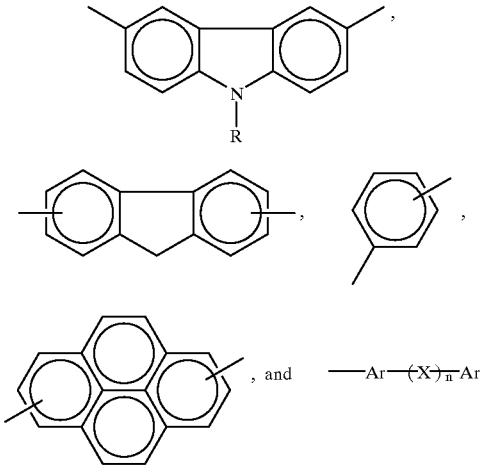

n is 0 or 1,

Ar is selected from the group consisting of

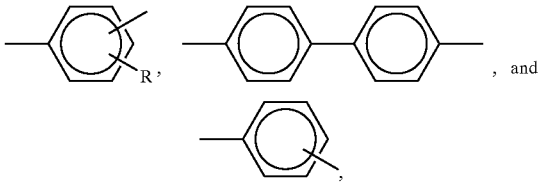

R is selected from the group consisting of —$CH_3$, —$C_2H_5$, —$C_3H_7$, and —$C_4H_9$, Ar' is selected from the group consisting of:

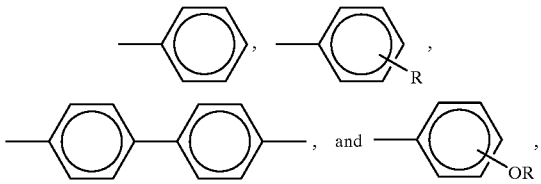

X is selected from the group consisting of:

—$CH_2$—, —$C(CH_3)_2$—, —O—, —S—,

-continued

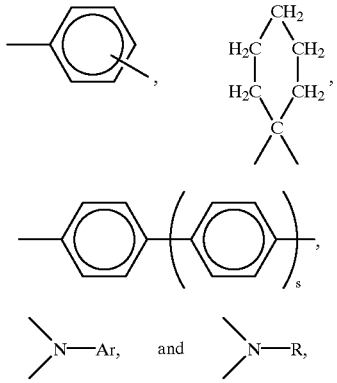

s is 0, 1 or 2

X' an alkylene radical selected from the group consisting of alkylene and isoalkylene groups containing 2 to 10 carbon atoms.

Other preferred polymeric compounds for the charge transport layer(s) are disclosed in Yanus et al., U.S. Pat. No. 4,806,444, the disclosure of which is totally incorporated herein by reference. In this patent, there are described polymeric compounds having the general structure shown below where the charge transport moiety is covalently bonded to the binder moiety (polycarbonate):

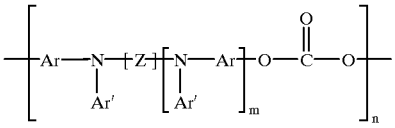

wherein:

n is between about 5 and about 5,000,

Z is selected from the group consisting of:

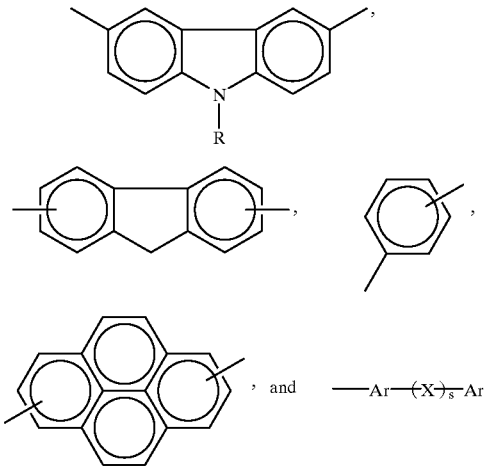

m is 0 or 1
s is 0, 1, 2 or 3

Ar is selected from the group consisting of:

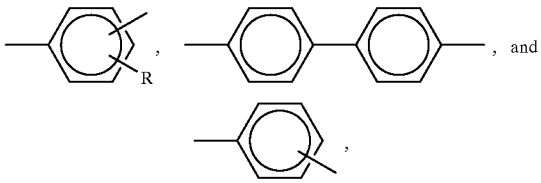

R is selected from the group consisting of —$CH_3$, —$C_2H_5$, —$C_3H_7$, and —$C_4H_9$, Ar' is selected from the group consisting of:

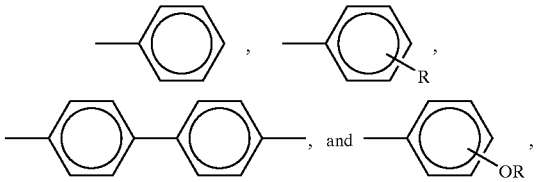

X is selected from the group consisting of:

—$CH_2$—, —$C(CH_3)_2$—, —O—, —S—,

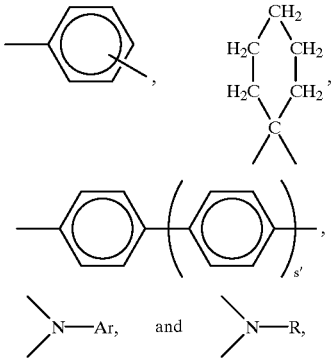

s' is 0, 1 or 2.

In embodiments of the present invention, the charge transport material is dispersed into a binder. In other embodiments, the term moiety as used for charge transport moiety and binder moiety refers to covalently bonded subunits within the polymeric compounds described herein.

Any suitable and conventional technique may be utilized to mix and thereafter apply each charge transport layer coating mixture. Typical application techniques include spraying, dip coating, roll coating, wire wound rod coating, and the like. Drying of the deposited coating may be effected by any suitable conventional technique such as oven drying, infra-red radiation drying, air drying and the like.

Generally, the thickness of each charge transport layer is between about 10 about 50 micrometers, but thickness outside this range can also be used. In general, the ratio of thickness of each charge transport layer to the charge generating layer is preferably maintained from about 2:1 to 200:1 and in some instances as great as 400:1.

Other layers may also be used such as a conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers.

The device of this invention has two transport layers: the first one having a low charge carrier mobility to provide for the delay of the discharge and the second one with much higher mobility to provide for fast discharge soon after the delay. During the operation, the device is corona charged and imagewise exposed. The photogenerated holes from the generator layer are injected into the first transport layer and because of the low charge carrier mobility move slowly through the first transport layer. Once these carriers reach the second transport layer with much higher mobilities, they move much faster through the second transport layer resulting in fast discharge rates following the delay caused during the slow motion through the first transport layer. The charge carrier mobility of the first transport layer of this invention determines the delay time of the discharge. The delay time requirements determine the mobility of the first transport layer through the relation $t_D \sim L^2/\mu V$ where $t_D$ is the delay time in seconds, L is the thickness of the first transport layer in centimeters, V is the voltage to which the device is charged and $\mu$ is the mobility of the first transport layer in $cm^2$/Volt-sec. In preferred embodiments, the charge transport layer having the lower charge carrier mobility value is closer to the charge generating layer than the charge transport layer having the higher charge carrier mobility value and the two charge transport layers are contiguous, i.e., without any intervening layers. In preferred embodiments, the first charge carrier mobility value, determined by the thickness of the first charge transport layer and the concentration of the charge transport material, is such that the photoreceptor exhibits a discharge delay time of between about 20 milliseconds to about 200 milliseconds and the second charge carrier mobility value is larger than about $10^{-6}$ $cm^2$/Volt second. The first charge carrier mobility value may be less than about $10^{-6}$ $cm^2$/Volt second.

The present inventors have found out that certain contiguous small molecule charge transport layers exhibit a phenomenon in that if the concentration of the charge transport material in each transport layer is unequal during fabrication of the photoreceptor, there will be diffusion of charge transport molecules between the layers resulting in the contiguous transport layers having approximately equal concentrations of the charge transport material. Where contiguous transport layers use the same charge transport material, this diffusion is generally undesirable for the present invention since the two layers will then have similar charge carrier mobility values. For example if a first transport layer is solvent coated with low concentration of small molecules dispersed in polycarbonate (the most commonly employed binder) followed by solvent coating a second transport layer with high concentration of the charge transporting small molecules in polycarbonate, as a result of inter diffusion, the resulting device will have almost equivalent small concentration in both layers (see Example III).

The present invention minimizes or eliminates such diffusion between the charge transport layers by: (i) where the charge transport material and the binder are physically mixed together in each transport layer, selecting the binder of one charge transport layer to have a lesser solubility limit for the charge transport material of that transport layer than the solubility limit of the binder for the charge transport material of the other transport layer; or (ii) wherein the first transport layer includes a first polymeric compound comprised of a first charge transport moiety covalently bonded to a first binder moiety and the second transport layer includes a second polymeric compound comprised of a second charge transport moiety covalently bonded to a second binder moiety, selecting the proportion of the first charge generating moiety in the first polymeric compound to be less than the proportion of the second charge generating moiety in the second polymeric compound. In the case of the first scheme described above, the low solubility limit of the binder employed in the first transport layer limits the diffusion of the molecules during the fabrication of the second transport layer. In the case of the second scheme employing polymeric layers, since there are no small molecules involved the intermixing is limited to just a thin portion of the two transport layers.

Unless otherwise indicated, the two transport layers can use the same or different charge transport material/charge transport moiety and the same or different binder/binder moiety. In embodiments, whether in terms of concentration or proportion, the first transport layer contains less of the charge transport material/charge transport moiety (wherein the first transport layer is closer to the charge generating layer) than the second transport layer, which generally means that the first transport layer will have a lower charge carrier mobility value. The preferred binder for the first transport layer having the lower charge carrier mobility value is poly(bisphenol A-co-epichlorohydrin) having a solubility limit of about 10% for N,N'-diphenyl-N,N'-bis(3-methylphenyl)-(1,1'-biphenyl)-4,4'diamine.

The two transport layers have the following illustrative amounts of the materials described herein. The concentration/proportion of the charge transport material/charge transport moiety in the first transport layer (which is closer to the charge generating layer than the second transport layer) may range for example from about 5% to about 20% by weight, preferably about 10% based on the weight of the first transport layer. The concentration/proportion of the binder/binder moiety in the first transport layer may range for example from about 80% to about 95% by weight, preferably about 90% based on the weight of the first transport layer. The concentration/proportion of the charge transport material/charge transport moiety in the second transport layer may range for example from about 30% to about 60% by weight, preferably about 50% based on the weight of the second transport layer. The concentration/proportion of the binder/binder moiety in the second transport layer may range for example from about 40% to about 70% by weight, preferably about 50% based on the weight of the second transport layer.

Figure 4:
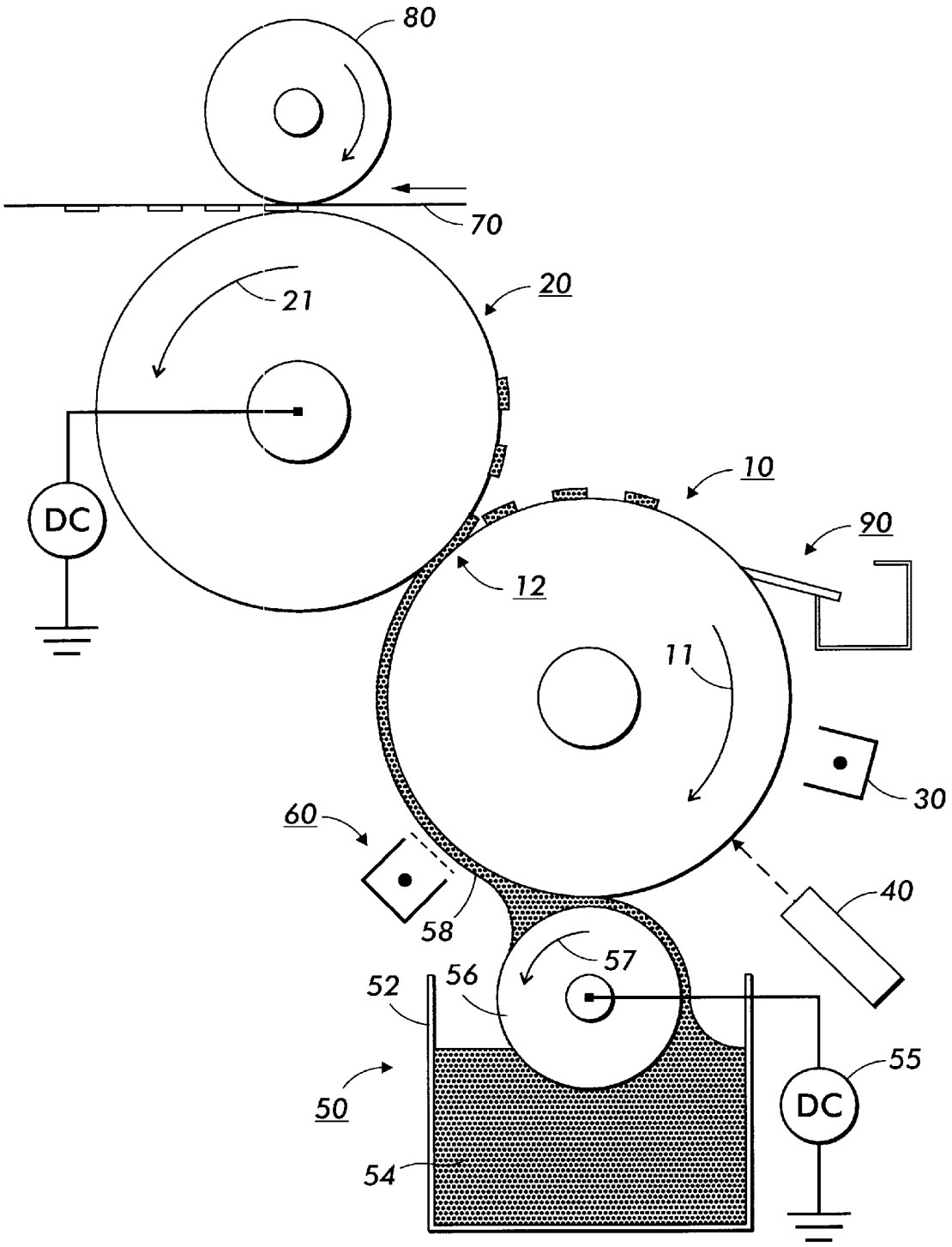
FIG. 4 is a schematic elevational view depicting a preferred contact electrostatic printing apparatus (employing an inventive photoreceptor) of the type used for development of an electrostatic latent image by placing a layer of concentrated liquid developing material in pressure contact with a latent image bearing surface.

Reference is now made to the FIG. 4 which illustrates an imaging apparatus constructed and operative in accordance with one possible embodiment of the present invention. The apparatus is composed of a first movable member in the form of an imaging member 10 including an imaging surface of any type capable of having an electrostatic latent image formed thereon. An exemplary imaging member 10 may be a photoreceptor as described herein with a surface layer having photoconductive properties supported on a conductive support substrate.

Imaging member 10 is rotated, as indicated by arrow 11, so as to transport the surface thereof in a process direction for implementing a series of image forming steps in a manner similar to typical electrostatographic printing processes. Initially, in the exemplary embodiment of the FIG. 4, the photoconductive surface of imaging member 10 passes through a charging station, which may include a corona generating device 30 or any other charging apparatus for applying an electrostatic charge to the surface of the imaging member 10. The corona generating device 30 is provided for charging the photoconductive surface of imaging member 10 device to a relatively high, substantially uniform potential. It will be understood that various charging devices, such as charge rollers, charge brushes and the like, as well as induction and semiconductive charge devices among other devices which are well known in the art may be utilized at the charging station for applying a charge potential to the surface of the imaging member 10.

After the imaging member 10 is brought to a substantially uniform charge potential, the charged surface thereof is advanced to an image exposure station, identified generally by reference numeral 40. The image exposure station projects a light image corresponding to the input image onto the charged photoconductive surface. The light image projected onto the surface of the imaging member 10 selectively dissipates the charge thereon for recording an electrostatic latent image on the photoconductive surface.

After the photoreceptor is exposed, a toner supply apparatus or applicator 50 is provided, as depicted in the exemplary embodiment of the FIG. 4, whereby a very thin layer of marking or toner particles (and possibly a carrier such as a liquid solvent) is transported onto the surface of the imaging member 10. The exemplary embodiment of the FIG. 4 shows an illustrative toner applicator 50, wherein a housing 52 is adapted to accommodate a supply of toner particles 54 and any additional carrier material, if necessary. In an exemplary embodiment, the toner applicator 50 includes an applicator roller 56 which is rotated in a direction as indicated by arrow 57 to transport toner from housing 52 into contact with the surface of the imaging member 10, forming a substantially uniformly distributed layer of toner, or a so-called "toner cake", 58 thereon.

The toner cake described above can be created in various ways. For example, depending on the materials utilized in the printing process, as well as other process parameters such as process speed and the like, a layer of toner particles having sufficient thickness, preferably on the order of between 2 and 15 microns and more preferably between 3 and 8 microns, may be formed on the surface of the imaging member 10 by merely transferring a ink cake of similar thickness and solid content from the applicator member 56. In an examplary embodiment, electrical biasing may be employed to assist in actively moving the toner cake from the applicator 56 onto the surface of the imaging member 10. Thus, the applicator roller 56 can be coupled to an electrical biasing source 55 for implementing a so-called forward biasing scheme, wherein the toner applicator 56 is provided with an electrical bias of magnitude greater than both the image and non-image (background) areas of the electrostatic latent image on the imaging member 10, thereby creating electrical fields extending from the toner applicator roll 56 to the surface of the imaging member 10. These electrical fields cause toner particles to be transferred to imaging member 10 for forming a substantially uniform layer of toner particles on the surface thereof.

It is noted that, in the case of liquid developing materials, it is desirable that the toner cake formed on the surface of the imaging member 10 should be comprised of at least approximately 10% by weight toner solids, and preferably in the range of 15%–35% by weight toner solids.

After the toner layer 58 is formed on the surface of the electrostatic latent image bearing imaging member 10, the toner layer is charged in an image-wise manner. In the case of a charged toner layer 58, as is the case in the system of the FIG. 4, a charging device 60, represented schematically in the FIG. 4 as a well known scorotron device, is provided for introducing free mobile ions in the vicinity of the charged latent image, to facilitate the formation of an image-wise ion stream extending from the source 60 to the latent image on the surface of the image bearing member 10. The function of the charging device 60 is to charge the toner layer 58 in an image-wise manner. In addition, the ion source 60 should provide ions having a charge opposite the original toner layer charge polarity. To achieve good image quality, the scorotron 60 is preferably provided with an energizing bias at its grid intermediate the potential of the image and non-image areas of the latent image on the imaging member 10. The image-wise ion stream generates a secondary latent image in the toner layer made up of oppositely charged toner particles in image configuration corresponding to the original latent image.

Once the secondary latent image is formed in the toner layer, the image-wise charged toner layer is advanced to the image separator 20 which rotates in direction 21. The image separator 20 may be provided in the form of a biased roll member having a surface adjacent to the surface of the imaging member 10 and preferably contacting the toner layer 58 residing on image bearing member 10. An electrical biasing source is coupled to the image separator 20 to bias the image separator 20 so as to attract either image or non-image areas of the latent image formed in the toner layer 58 for simultaneously separating and developing the toner layer 58 into image and non-image portions. In the embodiment of the FIG. 4, the image separator 20 is biased with a polarity opposite the charge polarity of the image areas in the toner layer 58 for attracting image areas therefrom, thereby producing a developed image made up of selectively separated and transferred portions of the toner cake on the surface of the image separator 20, while leaving background image byproduct on the surface of the imaging member 10. Alternatively, the image separator 20 can be provided with an electrical bias having a polarity appropriate for attracting non-image areas away from the imaging member 10, thereby maintaining toner portions corresponding to image areas on the surface of the imaging member, yielding a developed image thereon, while removing non-image or background areas with the image separator 20.

After the developed image is created, the developed image then may be transferred to a copy substrate 70 via any means known in the art such as a heated pressure roll 80. In a final step in the process the background image byproduct on either the imaging member 10 is removed from the surface thereof in order to clean the surface in preparation for a subsequent imaging cycle. The FIG. 4 illustrates a simple blade cleaning apparatus 90 for scraping the imaging member surface as is well known in the art. In a preferred embodiment the removed toner associated with the background image is transported to a toner sump or other reclaim vessel so that the waste toner can be recycled and used again to produce the toner cake in subsequent imaging cycles.

With respect to the foregoing imaging and development method, it is understood that the requirements on a photoreceptor is different from that of a conventional xerographic process. In a typical electrostatographic printing process, the latent image comprised of image and non-image areas with different charge levels is developed into a visible image in the very next development step. Thus, it is preferred that the electrostatic latent image is established immediately on the surface of the imaging member after the photoreceptor exposure. By contrast, in the illustrated embodiment of CEP process, the voltage contrast of the latent image is not used until the corresponding portions of the photoreceptor pass through the charging device 60. Furthermore, the earlier presence of the latent image during the ink cake loading step can pose either challenges for cake uniformity or the fidelity of the latent image. With the current invention in which a photoreceptor with a delayed discharge is achieved, the latent image voltage contrast can be avoided during the cake loading and full contrast can be established quickly before recharge. Thus, in a preferred embodiment of the current invention when used in the illustrated CEP process, the delay time for the photoreceptor discharge should be longer than the lapse time for the photoreceptor to move from the exposure device 40 to cake loading device 56 and shorter than the lapse time to move between exposure device 40 and charging device 60.

The inventive photoreceptor can be tested for charge carrier mobility by employing the time of flight technique. The time of flight experiment is carried out on a sandwich structure consisting of the inventive photoreceptor and a vacuum deposited semi-transparent gold electrode. This sandwich structure was connected in a circuit containing a voltage power supply and a current measuring series resistance. The principal underlying this time of flight test is that when the gold electrode is biased negatively and the photoreceptor exposed to a flash of light, holes photogenerated in the charge generating layer are injected into and drift through the charge transport layer. The electric current due to the carrier transit is time resolved and displayed on an oscilloscope. A constant current followed by a sharp drop-off was observed. The point at which the sharp drop occurs is the transit time. The transit time $t_{tr}$ is equal to the thickness of the transport layer divided by velocity, i.e., $t_{tr}$=(TL thickness)/velocity. The relationship between the velocity and charge carrier mobility is velocity=(mobility)×(electric field).

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE I

Two photoreceptors were fabricated by forming coatings using conventional techniques on a substrate comprising a vacuum deposited titanium layer on a flexible polyethylene terephthalate film having a thickness of 3 mil (76.2 micrometers). The first coating was a siloxane barrier layer formed from a hydrolyzed gamma aminopropyltriethoxysilane having a thickness of 0.005 micrometer (50 Angstroms). This layer was coated from a mixture of 3-aminopropyltriethoxysilane (available from PCR Research Chemicals of Florida) in ethanol in a 1:50 volume ratio. The coating was applied in a wet thickness of 0.5 mil by a multiple clearance film applicator. The coating was then allowed to dry for 5 minutes at room temperature, followed by curing for 10 minutes at 110 degree centigrade in a forced air oven. The next applied coating was an adhesive layer of polyester resin (49,000, available from E.I. duPont de Nemours & Co.) having a thickness of 0.005 micron (50 Angstroms) and was coated from a mixture of 0.5 gram of 49,000 polyester resin dissolved in 70 grams of tetrahydrofuran and 29.5 grams of cyclohexanone. The coating was applied by a 0.5 mil bar and cured in a forced air oven for 10 minutes. This adhesive interface layer was thereafter coated with a photogenerating layer (CGL) containing 40 percent by volume hydroxygallium phthalocyanine and 60 percent by volume copolymer polystyrene (82 percent)/poly-4-vinyl pyridine (18 percent) with a $M_w$ of 11,000. This photogenerating coating mixture was prepared by introducing 1.5 grams polystyrene/poly-4-vinyl pyridine and 42 ml of toluene into a 4 oz. amber bottle. To this solution was added 1.33 grams of hydroxygallium phthalocyanine and 300 grams of ⅛ inch diameter stainless steel shot. This mixture was then placed on a ball mill for 20 hours. The resulting slurry was thereafter applied to the adhesive interface with a Bird applicator to form a layer having a wet thickness of 0.25 mil. The layer was dried at 135° C. for 5 minutes in a forced air oven to form a dry thickness photogenerating layer having a thickness of 0.4 micrometer.

EXAMPLE II

On one of the two generator layers of example I a first transport layer was coated on top of the generator layer. The first transport layer contained N,N'-diphenyl-N,N'-bis(3-methylphenyl)-(1,1'biphenyl)-4,4'-diamine (referred herein as "TBD") molecularly dispersed in a phenoxy resin, poly (bisphenol A-co-epichlorohydrin), available as phenoxy resin from Union Carbide. The first transport layer were coated using methylene chloride. First, one gram of phenoxy resin polymer was dissolved in 20 grams of the solvent to form a polymer solution. About 0.1 gram of TBD was dissolved in the polymer solution. The first charge transport layer coatings was formed using a Bird coating applicator. The TBD is an electrically active aromatic diamine charge transport small molecule whereas the phenoxy resin is an electrically inactive film forming binder. The coated was dried at 80° C. for half an hour in a forced air oven to form a 5 micrometer thick first charge transport layer on the coated members. The second transport layer contained TBD molecularly dispersed in a polycarbonate resin, poly(4,4'-isopropylidene-diphenylene carbonate), available as Makrolon® from Farbenfabricken Bayer A.G. The second transport layer was coated using methylene chloride. First, 1.2 gram of polycarbonate resin polymer was dissolved in 13.2 grams of the solvent to form a polymer solution. About 1.2 gram of TBD was dissolved in the polymer solution. The second charge transport layer coatings was formed using a Bird coating applicator. The coated device was dried at 80° C. for half an hour in a forced air oven to form a 20 micrometer thick second charge transport layer on the coated member.

EXAMPLE III (COMPARATIVE)

On second of the two generator layers of example I a first transport layer was coated on top of the generator layer. The first transport layer contained N,N'-diphenyl-N,N'-bis(3-methylphenyl)-(1,1,'biphenyl)-4,4'-diamine (referred herein as "TBD") molecularly dispersed in a polycarbonate resin, poly(4,4'-isopropylidene-diphenylene carbonate), available as Makrolon® from Farbenfabricken Bayer A.G. The first transport layer was coated using methylene chloride. First, one gram of polycarbonate resin was dissolved in 20 grams of the solvent to form a polymer solution. About 0.1 gram of TBD was dissolved in the polymer solution. The first charge transport layer coating was formed using a Bird coating applicator. The TBD is an electrically active aromatic diamine charge transport small molecule whereas the polycarbonate resin is an electrically inactive film forming binder. The coated was dried at 80° C. for half an hour in a forced air oven to form a 5 micrometer thick first charge transport layer on the coated member. The second transport layer contained TBD molecularly dispersed in a polycarbonate resin, poly(4,4'-isopropylidene-diphenylene carbonate), available as Makrolon® from Farbenfabricken Bayer A.G. The second transport layer was coated using methylene chloride. First 1.2 gram of polycarbonate resin polymer was dissolved in 13.2 grams of the solvent to form a polymer solution. About 1.2 gram of TBD was dissolved in the polymer solution. The second charge transport layer coatings was formed using a Bird coating applicator. The coated device was dried at 80° C. for half an hour in a forced air oven to form a 20 micrometer thick second charge transport layer on the coated member.

EXAMPLE IV

The devices of the previous Examples were tested in a flat plate scanner. In the flat plate scanner a stainless steel plate was capable of moving in a transverse direction back and forth. It was capable of stopping at the two end positions as well as in the center. The photoconductor film mounted on the plate during the transverse position passed under a corotron and came to the stop position under a probe. The probe was a wire loop through which exposure was accomplished by a xenon flash light source. The wire loop was connected to an electrometer whose output was displayed on a recorder. The changes in the photoreceptor potential when exposed to a light flash were picked by the wire loop and displayed on the recorder. The discharge characteristics of photoreceptors described in Examples II and III were measured by the plate scanner. The discharge characteristics of the photoreceptor in Example II showed that after the exposure there was 0.3 second delay during which time initial potential of 800 Volts discharged to 600 Volts followed by a rapid discharge to 100 Volts. There was no such delay when the device of Example III was measured. The discharge followed soon after the light exposure indicative of complete mixing of the transport molecules between the two layers creating a essentially uniform concentration profile in the two transport layers.

EXAMPLE V

The photoreceptors of Examples II and III were tested for charge carrier mobility by employing the time of flight technique described herein. The device of Example II in fact showed signals consistent with the slow motion through the first transport layer followed by fast motion through the second transport layer. The device of Example III showed time of flight signals consistent with fast motion through a uniform composition layer indicating that small charge transport molecules from the second transport layer had diffused into the first transport layer.

EXAMPLE VI

COPOLYMER A: Copolymer of N,N'-diphenyl-N,N'-bis(3-hydroxyphenyl)-(1,1'-biphenyl)-4,4'diamine/4,4'-dihydroxy-diphenyl-2,2-propane and diethyleneglycol bischloroformate.

Into a 1000 milliliter three-necked round bottom flask Morton equipped with a mechanical stirrer, an argon inlet and a dropping funnel was placed 7.1 grams bisphenol A (0.03 mole), 5.2 grams N,N'-diphenyl-N,N'-bis(3-hydroxyphenyl)-(1,1'-biphenyl)-4,4'diamine (0.01 mole), 240 grams deionized water, 11.2 grams potassium hydroxide (0.2 mole), 25 milliliters tetrahydrofuran, and 2.7 grams benzyltriethyl ammonium chloride. The stirred solution was cooled in an ice bath and a solution of 300 milliliters methylene chloride and 9.2 grams diethyleneglycol bischloroformate (0.04 mole) was added over 30 minutes. The mixture was warmed to room temperature and was stirred for one hour. The mixture was transferred to a separatory funnel and the organic phase separated from the alkaline water phase. The organic phase was washed with 3×150 milliliters of water until the water phase was neutral (pH 7). The polymer solution (organic phase) was then precipitated into 3 liters of methanol. The polymer was filtered, washed with methanol and dried. Yield of polymer was 13.2 grams and the molecular weight, determined by gel permeation chromatography against a polystyrene standard was Mw 94,000 and Mn 37,000 (molecular weight distribution, MwD 2.57).

EXAMPLE VII

A 0.5 micrometer thick layer of amorphous selenium was vacuum deposited on an aluminum substrate as described in U.S. Pat. No. 4,265,990, the disclosure of which is totally incorporated by reference. The first charge transport layer was prepared by dissolving 1 gram of a copolymer of N,N'-diphenyl-N,N'-bis(3-hydroxyphenyl)-(1,1'-biphenyl)-4,4'diamine/4,4'-dihydroxy-diphenyl-2,2-propane and diethyleneglycol bischloroformate (copolymer A of Example VI) in 10 grams methylene chloride. A 5 micrometer thick layer of this solution was formed on the amorphous selenium layer using a 1 mil Bird film applicator. The coating was then vacuum dried at 40° C. for 2 hours. A second solution was prepared by dissolving 5 grams poly(N,N'-diphenyl-N,N'-bis(3-hydroxyphenyl)-(1,1'-biphenyl)-4,4'diamine) diethylene glycol biscarbonate (polymer B) in 20 grams of methylene chloride. Polymer B was prepared by using the procedures of U.S. Pat. No. 5,419,992 (Example II), the disclosure of which is totally incorporated herein by reference. A 20 micrometer thick layer of polymer B solution was formed on the amorphous Se/Polymer A device using a 4 mil Bird film applicator. The photoreceptor was vacuum dried at 40° C. for 18 hours.

EXAMPLE VIII

The discharge characteristics of the photoreceptor described in Example VII are measured by the flat plate scanner described in Example IV. The discharge characteristics of the photoreceptor showed that after the exposure there was 0.3 second delay during which time initial potential of 800 volts discharged to 550 Volts followed by a rapid discharge to 100 volts.

Other modifications of the present invention may occur to those skilled in the art based upon a reading of the present disclosure and these modifications are intended to be included within the scope of the present invention.

We claim:

1. A photoreceptor having a substrate, comprising:

(a) a charge generating layer;

(b) a first charge transport layer having a first charge carrier mobility value; and (c) a second charge transport layer having a second charge carrier mobility value, wherein the first charge transport layer is closer to the charge generating layer than the second charge transport layer and the second charge transport layer is contiguous to the first charge transport layer, wherein the first charge carrier mobility value is lower than the second charge carrier mobility value to the extent that the photoreceptor upon exposure to a light source exhibits a discharge delay resulting from the slowness of the charges passing through the first charge transport layer, wherein the first transport layer includes a first polymeric compound comprised of a first charge transport moiety covalently bonded to a first binder moiety and the second transport layer includes a second polymeric compound comprised of a second charge transport moiety covalently bonded to a second binder moiety, and wherein the proportion of the first charge transport moiety in the first polymeric compound is less than the proportion of the second charge transport moiety in the second polymeric compound.

2. The photoreceptor of claim 1, wherein the charge generating layer is adjacent to the substrate.

3. The photoreceptor of claim 1, further comprising a blocking layer between the substrate and the charge generating layer.

4. The photoreceptor of claim 1, wherein the second charge carrier mobility value is larger than about $10^{-6}$ $cm^2$/Volt second.

5. The photoreceptor of claim 1, wherein the first charge transport moiety is a first aromatic diamine and the second charge transport moiety is a second aromatic diamine.

6. The photoreceptor of claim 1, wherein the discharge delay ranges from about 20 milliseconds to about 200 milliseconds.

7. The photoreceptor of claim 1, wherein the discharge delay is 0.3 second.

* * * * *